US005431137A

United States Patent [19]

Elsbett et al.

[11] Patent Number: 5,431,137

[45] Date of Patent: Jul. 11, 1995

[54] INTERNAL COMBUSTION ENGINE

[75] Inventors: Ludwig Elsbett; Günther Elsbett; Klaus Elsbett, all of Hilpoltstein, Germany

[73] Assignee: Elsbett Konstruktion, Hilpoltstein, Germany

[21] Appl. No.: 133,117

[22] PCT Filed: Apr. 10, 1992

[86] PCT No.: PCT/DE92/00296

§ 371 Date: May 2, 1994

§ 102(e) Date: May 2, 1994

[87] PCT Pub. No.: WO92/18762

PCT Pub. Date: Oct. 29, 1992

[30] Foreign Application Priority Data

Apr. 10, 1991 [DE] Germany ..... 41 11 716.6
Jul. 27, 1991 [DE] Germany ..... 41 24 999.2

[51] Int. Cl.[6] ..... F02F 11/00; F02F 1/24

[52] U.S. Cl. ..... 123/193.5

[58] Field of Search ..... 123/193.5, 193.3, 193.2, 123/90.27

[56] References Cited

U.S. PATENT DOCUMENTS

| | | | |
|---|---|---|---|
| 4,438,734 | 3/1984 | Hayashi | 123/193.5 |
| 5,095,868 | 3/1992 | Brighigna | 123/193.5 |
| 5,123,385 | 6/1992 | Sado et al. | 123/193.5 |
| 5,150,675 | 9/1992 | Murata | 123/193.5 |

FOREIGN PATENT DOCUMENTS

| | | | |
|---|---|---|---|
| 0124045 | 7/1983 | Japan | 123/193.5 |

*Primary Examiner*—Andrew M. Dolinar
*Assistant Examiner*—M. Macy
*Attorney, Agent, or Firm*—Darby & Darby

[57] ABSTRACT

For a static design of a cylinder head with optimum weight characteristics, it is proposed that the cylinder head bolt holes be disposed in a solid annular ring and, starting from that, a support element in the form of a cone-shaped shell be constructed towards the center of the cylinder head plate, the forces being directed in a straight line towards the center of the cylinder. A support ring forms the contact between the cylinder and the head.

9 Claims, 1 Drawing Sheet

INTERNAL COMBUSTION ENGINE

Figure 1:
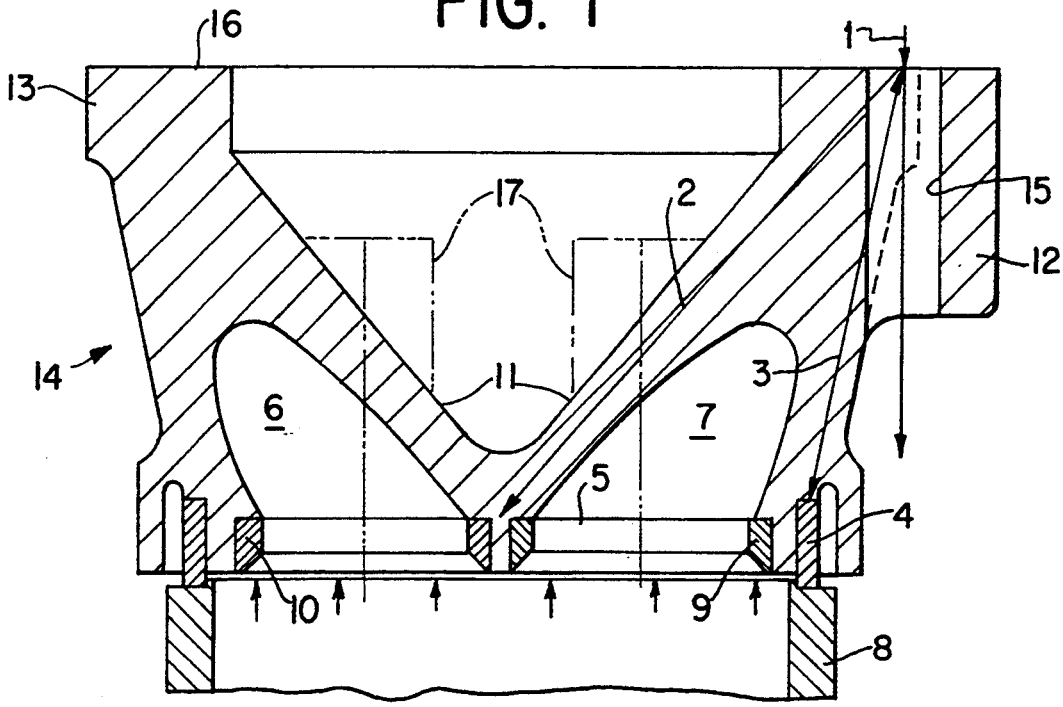

The invention starts out from an internal combustion with at least one cylinder. The cylinder has a compression side opening closed off with a cylinder head that is fastened with bolts to the cylinder. A contact zone between the cylinder and the cylinder head is constructed in an annular fashion and lies within a circle fixed by anchoring points of the bolts in the cylinder.

An internal combustion engine with a cylinder head of lightweight construction is known from the German patent 348,632. By means of this, however, the cylinder head plate is not supported in any manner in the center. Due to the enormous pressures, which arise in modern engines, particularly in diesel engines, there can be deformation of the cylinder head plate with severe wear at the valve seats.

It is an object of the invention to provide an internal combustion engine, which avoids the disadvantages of the state of the art and, despite the lightweight construction, holds the cylinder head plate rigidly.

This objective is accomplished by the distinguishing characteristics of the main claim. The compression forces, which act on the center of the cylinder head plate, can be transferred in this way with the least possible expenditure of materials into the bolts. Due to the solid construction of the annular ring at the side of the cylinder head averted from the cylinder, a divergence of the fastening points is prevented even at high pressures. This occurs even if only four bolts are used per cylinder.

An annular support in the shape of a truncated cone distributes the load uniformly over the contact zone, so that there are no static shifts and so that no leaks can develop. In order to ensure the correct distribution of the contacting forces on the supporting part, which is in the form of a cone-shaped shell, and on the annular support, which is in the shape of a truncated cone, the bolts supports are connected only with the half of the cylinder head averted from the cylinder.

Since the solid annular ring connects the fastening points for the bolts in a statically stable ring, it is possible to forego an upper cover for the cylinder head. In this way, control parts for the valve shafts can be integrated already in the head and the overall height of the internal combustion engine can be reduced.

The inlet and exhaust ports can be designed so that they are disposed only on the side of the supporting part in the form of a cone-shaped shell, which is facing the cylinder. By these means, the static stability of the supporting part is interrupted only by the recesses for the valve shaft.

In order to uncouple the cylinder from the cylinder head and thus not necessarily transfer thermally caused deformations from one part to another, a supporting ring is provided, which prevents contact between the two parts. Advantageously, this supporting ring is constructed from a deformable material, such as steel, so that it can adapt itself appropriately.

This form-stiff sealing ring is used between the upper part of the cylinder and the cylinder head and has about the same wall thickness as the upper part of the cylinder. Expansion of the upper end of the cylinder by gas pressure is prevented by a conformation, which comprises the upper part of the cylinder. As a result, the gas tightness of the piston is improved already above the first piston ring. In addition, the cooling (oil cooling) of the supporting ring prevents the static and thermal expansion of the upper end of the cylinder, so that the forces are introduced from the cylinder head under constant conditions into the cylinder.

The invention is explained in greater detail by means of the drawings, in which

Figure 2:
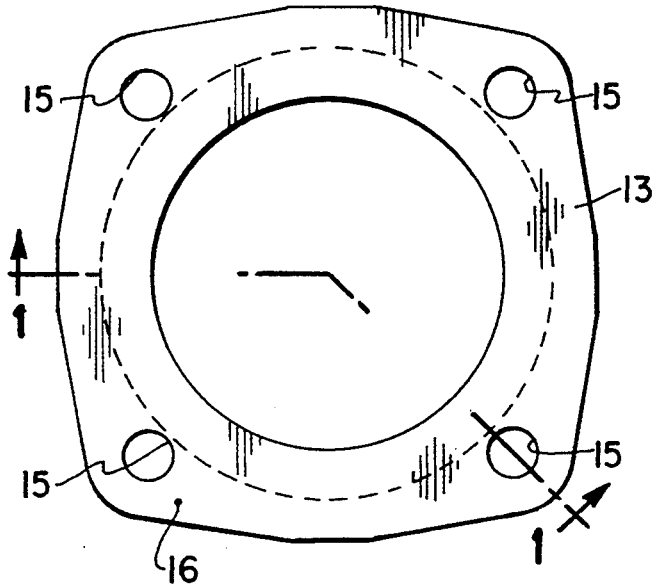
Figure 3:
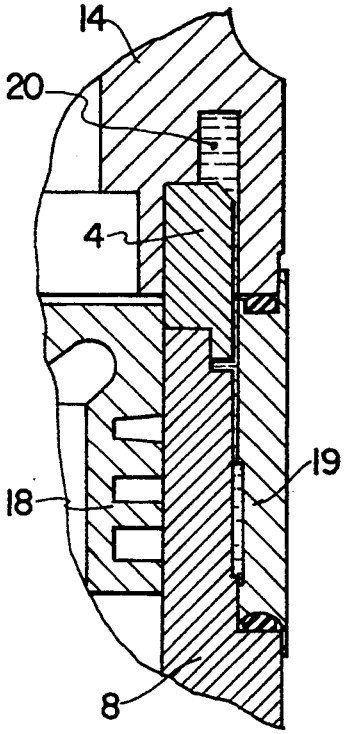

FIG. 1 shows a longitudinal section through an inventive cylinder head and cylinder, FIG. 2 shows a plan view of the cylinder head of FIG. 1 and FIG. 3 shows a longitudinal section, similar to that of FIG. 1, in the area of the supporting ring.

In FIG. 1, the subsequent distribution of forces to the center of the cylinder head plate through force vector 2 and, over the annular support through force vector 3, to the edge and to the supporting ring 4 is characterized by the introduction of forces 1 through a bolt in the bolt opening 15 fastening the cylinder head. This ensures that the head plate 5, which must withstand the gas pressure acting in the cylinder 8, cannot be deformed. Any deformation would bring the valve seats 9 and 10 into motion and thus reduce the service life of the engine because of the wear of the valve and the valve seat. The mixing and combustion processes would also be adversely affected by such bending oscillations.

The shape of the inlet and exhaust ports 6 and 7 is subordinate to the shape of the supporting cone 11 of the cylinder head 14.

The length of the bolt supports 12 in the annular ring 13 is limited so that the effect of the annular support 3 on the uniform distribution of forces over the whole periphery is not affected. The supporting ring 4 has the task of ensuring the gas tightness with the uniform peripheral force of the bolt pressure. The borehole 17 to the valve guide protrudes over the supporting part 11 in the form of a cone-shaped shell.

FIG. 2 shows the ring plate 13, which holds all four cylinder head bolts together in direct force flow and also guarantees the introduction of bolt forces into the form-stiff supporting cone 11.

FIG. 3, like FIG. 1, shows a longitudinal section in the area of the supporting ring 4 through the cylinder 8 and the cylinder head 14 of a piston internal combustion engine, in which the piston 18 is in the uppermost piston position. A form-stiff metallic sealing and supporting ring 4 protrudes over the cylinder 8 and surrounds it and protrudes into the cylinder head 14. A cooling medium 20 washes around the upper part of the cylinder in the area of the ring carrier of the piston 18; a cooling sleeve 19 seals off the cooling liquid from the outside.

In order to ensure a statical cylinder-head 14 designed with optimum weight characteristics, cylinder-head bolt holes 15 are located in the annular ring 13 and supported by the support part 11 in the shape of a hollow cone that extends from the ring to the middle of the cylinder-head plate 5. Forces are thereby directed in a straight line in towards the center and onto the cylinder 8. A support ring 4 links the cylinder 8 to the cylinder head 14.

We claim:

1. An internal combustion engine with at least one cylinder, the compression side opening of which is closed off with a cylinder head, which is fastened with bolts to the cylinder and for which the contact zone between the cylinder and the cylinder head is constructed in annular fashion and lies within the circle fixed by the anchoring points of the bolts in the cylinder, wherein the bolt openings are disposed in a solid annular ring and a portion of the contacting forces of the bolts is passed from the bolts through the annular ring and a supporting part, which is in the form of a cone-shaped shell, in a straight line to the center of the cylinder head plate.

2. The internal combustion engine of claim 1, wherein a portion of the contacting forces is conducted through the annular ring and an annular support, which is in the shape of a truncated cone, in a straight line to the contact zone.

3. The internal combustion engine of claim 1, wherein the straight connection lines between the bolts in the force introduction plane run within the annular ring.

4. The internal combustion engine of claim 1, wherein the bolt supports are only in about the upper half of the cylinder head.

5. The internal combustion engine of claim 1, wherein the cylinder head is open at its side averted from the cylinder.

6. The internal combustion engine of claim 1, wherein the inlet and exhaust ports are disposed in the cylinder head to adapt to the supporting part, which is in the form of a cone-shaped shell being interrupted only by the valve shaft recesses.

7. The internal combustion engine of claim 1, wherein the contact between the cylinder and the cylinder head is brought about by a supporting ring.

8. The internal combustion engine of claim 7, wherein the supporting ring embraces the cylinder.

9. The internal combustion engine of claim 7, wherein the supporting ring embraces the cylinder head at a position level with the valve seat.

* * * * *